United States Patent [19]

Morton

[11] Patent Number: 4,913,856

[45] Date of Patent: Apr. 3, 1990

[54] HUMIDIFIER SYSTEM

[75] Inventor: Bernard W. Morton, Minnetonka, Minn.

[73] Assignee: Dri-Steem Humidifier Company, Hopkins, Minn.

[21] Appl. No.: 380,672

[22] Filed: Jul. 14, 1989

Related U.S. Application Data

[63] Continuation of Ser. No. 152,321, Feb. 4, 1988, abandoned.

[51] Int. Cl.[4] ..... B01F 3/04

[52] U.S. Cl. ..... 261/116; 261/DIG. 15; 261/DIG. 76

[58] Field of Search ..... 261/116, 118, 78.2, 261/DIG. 15, DIG. 75, DIG. 76, DIG. 54; 126/113; 239/132, 132.1, 550, 556; 422/4, 123; 98/30

[56] References Cited

U.S. PATENT DOCUMENTS

| | | | |
|---|---|---|---|
| 1,933,039 | 10/1933 | Anderson | 261/78.2 |
| 2,217,130 | 10/1940 | Niehart | 261/116 X |
| 2,424,654 | 7/1947 | Gamble | 261/DIG. 54 |
| 2,450,571 | 10/1948 | Bahnson, Jr. | 261/78.2 X |
| 2,884,205 | 4/1959 | Van Buren | 261/78.2 X |
| 3,570,472 | 3/1971 | Santangelo | 261/116 X |
| 3,638,924 | 2/1972 | Calaceto et al. | 261/DIG. 54 |
| 3,724,180 | 4/1973 | Morton et al. | 261/DIG. 76 |
| 3,855,371 | 12/1974 | Morrow et al. | 261/100 |
| 3,857,514 | 12/1974 | Clifton | 261/DIG. 76 |
| 3,990,427 | 11/1976 | Clinebell | 126/113 |
| 4,006,674 | 2/1977 | Culver | 98/105 |
| 4,026,682 | 5/1977 | Pausch | 261/DIG. 54 |
| 4,083,932 | 4/1978 | Muraco et al. | 261/116 X |
| 4,174,362 | 11/1979 | Rahman | 261/90 |
| 4,257,389 | 3/1981 | Texidor et al. | 126/113 |
| 4,278,617 | 7/1981 | Rahman | 261/30 |
| 4,354,985 | 10/1982 | Johnson | 261/100 |

FOREIGN PATENT DOCUMENTS

| | | | |
|---|---|---|---|
| 2325120 | 10/1974 | Fed. Rep. of Germany | 261/DIG. 76 |
| 6432 | 5/1887 | United Kingdom | 261/DIG. 76 |

*Primary Examiner*—Richard L. Chiesa
*Attorney, Agent, or Firm*—Nickolas E. Westman

[57] ABSTRACT

A humidifier system where atomized water is caused to be rapidly evaporated as a result of being strategically located in the path of high velocity turbulent air created by converging deflector vane sets, and delivered to an outlet duct end for further distribution. An alternative embodiment illustrates a humidifier system where a central steam tube is substituted for the atomizing nozzles and steam fog is discharged into the high velocity turbulent air plane. Angled orifices in the central steam tube disperse steam against the air flow to further disperse steam within the humidifier assembly.

5 Claims, 5 Drawing Sheets

10
108a
34
32
12n
50
44
22
96
40
62a
60a
64a
80
82
92
90
15
100
98
16
14a
62n
60n
64n
94
108n
36
42
38
12a
46
52
48
30
20
28a
28n
18
14n
32

130
24
12n
108a
AIR FLOW
96
94
92
AIR FLOW
90
98
112
100
15
82
16
80
18
14a
20
138a
134
102
80a
104
136
14n
32
156
132
110
82a
132
150
154a
152
154b
158
26
12a

HUMIDIFIER SYSTEM

CROSS REFERENCES TO C0-PENDING APPLICATIONS

This is a continuation of application Ser. No. 07/152,321, filed Feb. 4, 1988, abandoned as of the date of this application.

BACKGROUND OF THE INVENTION

1. Field of the Invention

The present invention pertains to a humidifying system, and more particularly, pertains to injection and evaporation of atomized mist or steam fog into a heating and/or air conditioning air distribution duct system or directly into the room itself.

2. Description of the Prior Art

The prior art has not utilized air deflector vanes to accelerate the absorption of moisture discharged from spray nozzles or the orifices of a steam tube into the air of a duct system. Unabsorbed fog or mist carried by the air in a duct system often impinges upon solid objects in the duct such as dampers, fans, etc., making them wet. Wet areas in ducts are spawning grounds for bacteria and disease germs. This invention eliminates wet ducts.

The present invention provides air deflector vanes for the creating of a zone of concentrated and turbulent air flow about the nozzles of a water atomizer or the orifices of a steam tube in a duct system or in a room.

SUMMARY OF THE INVENTION

The general purpose of the present invention is that of a humidifier encompassing a dispersion system which eliminates wetness in air distribution systems caused by incomplete absorption of the moisture introduced by steam or atomized water (fog) humidifiers.

One embodiment of the present invention consists of an assembly, fabricated of dimensions to encompass the cross section of the air distribution duct to which it is to be applied. All of the air flowing in the duct must flow through the device.

Assuming the distribution duct is horizontal, depending on the height of the duct, one or more pairs of deflector vanes are stacked on a vertical plane in this assembly. The individual blades of each pair of blades are angled towards each other to cause the air flowing through them to be converged into a zone or plane of high velocity air which expands abruptly at the outlet of the converging blades and becomes turbulent air flow in the duct. The angle of deflection has bearing on the amount of resistance to air flow created by this device. Therefore, the deflection angle of each pair of blades is adjustable to permit the device to be adjusted to accommodate the capability to overcome the air flow resistance of the air distribution system to which it is being applied.

It is into this turbulent air that the moisture to be evaporated is introduced by a spray manifold. This manifold consists of a series of atomizing nozzles spaced horizontally across the width of the duct. Each nozzle is supplied with water from a pressurized water source and compressed air from a compressed air source. This series of nozzles is appropriately spaced along and within the turbulent air discharged from the outlet ends of the converging blades. The particles of mist created by these spray nozzles are thus brought into contact with the turbulent at the outlet of the distribution system, the result being higher degrees of saturation of the air in shorter distances of mist travel, with less fallout of moisture than with previous humidifiers.

An alternative embodiment of the present invention utilizes a steam tube which disperses steam fog instead of having atomizing nozzles discharging mist into the turbulent air zone.

The steam tube spans the full width of the air stream and is supplied with steam from a steam source. It has a series of steam openings in the wall of the tube appropriately spaced along a line extending the full length of the tube. The tube is mounted in the path of the converging air stream and discharges steam fog into the turbulent zone of the air stream.

A further alternative embodiment of the present invention utilizes atomizers of the electrically operated ultrasonic type. In this atomizer a rapidly oscillating surface creates the vibratory force which breaks water up into tiny mist particles. These ultrasonic atomizers would be substituted for the air atomizing type previously described.

The above description pertains to installing the device in a horizontal duct with the air deflector vanes mounted horizontally and stacked on a vertical line. In some horizontal duct applications installing the device with the air deflector vanes mounted vertically and in the horizontal line transversing the duct, will be more advantageous. In still other applications where the duct is vertical, the device will be installed with the air deflector vanes mounted horizontally and in a horizontal line transversing the duct.

One significant aspect and feature of the present invention is a humidifier system which atomizes water by forcing it through a constricted opening under high pressure or shearing it to tiny bits through the shearing action of compressed air and disperses it into a concentrated air stream.

Another significant aspect and feature of the present invention is a humidifier system which uses one or more pairs of converging deflector blades to converge a ducted air stream into one or more concentrated zones, which expand and become turbulent at the outlet ends of the blades where the mist is released and quickly absorbed by the air.

Another significant aspect and feature of the present invention is the dispersion of steam fog from a steam tube into an expanding, turbulent air stream where it is quickly absorbed by the air.

Still another significant aspect and feature of the present invention is the dispersion into a rapidly expanding, turbulent airstream, mist, created by bringing water in contact with an electrically operated rapidly vibrating solid surface.

Having thus described the embodiments of the present invention, it is the principal object hereof to provide a humidifier system wherein a zone of air concentration is created by air deflector blades, which expands at the outlet end of the deflector blades and becomes turbulent, and it is into this turbulent region the moisture is discharged.

One object of the present invention is a humidifier system which causes atomized water or steam fog to be much more rapidly and completely evaporated by the moving air stream in a duct system than was previously possible, and do this with substantially no fallout of moisture.

Another object of the present invention is the use of air deflecting vanes to cause the air stream to converge into a narrow plane or zone of high velocity and then expanding to create turbulence. This region of turbulence spans the total width or height of the air stream. The atomizers or steam discharge ports are strategically located along this turbulent region which results in the mist or fog pattern being exposed to a turbulent air pattern. This intimate intermingling of mist or fog with the air results in much more rapid evaporation of the mist or fog, thus causing a considerably shortened distance of mist or fog travel within the duct. By so locating the entire humidifier assembly in an area of the duct system that is free of internal solid objects immediately downstream, impingement of mist or fog on these objects with resultant water accumulation, is thereby eliminated.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
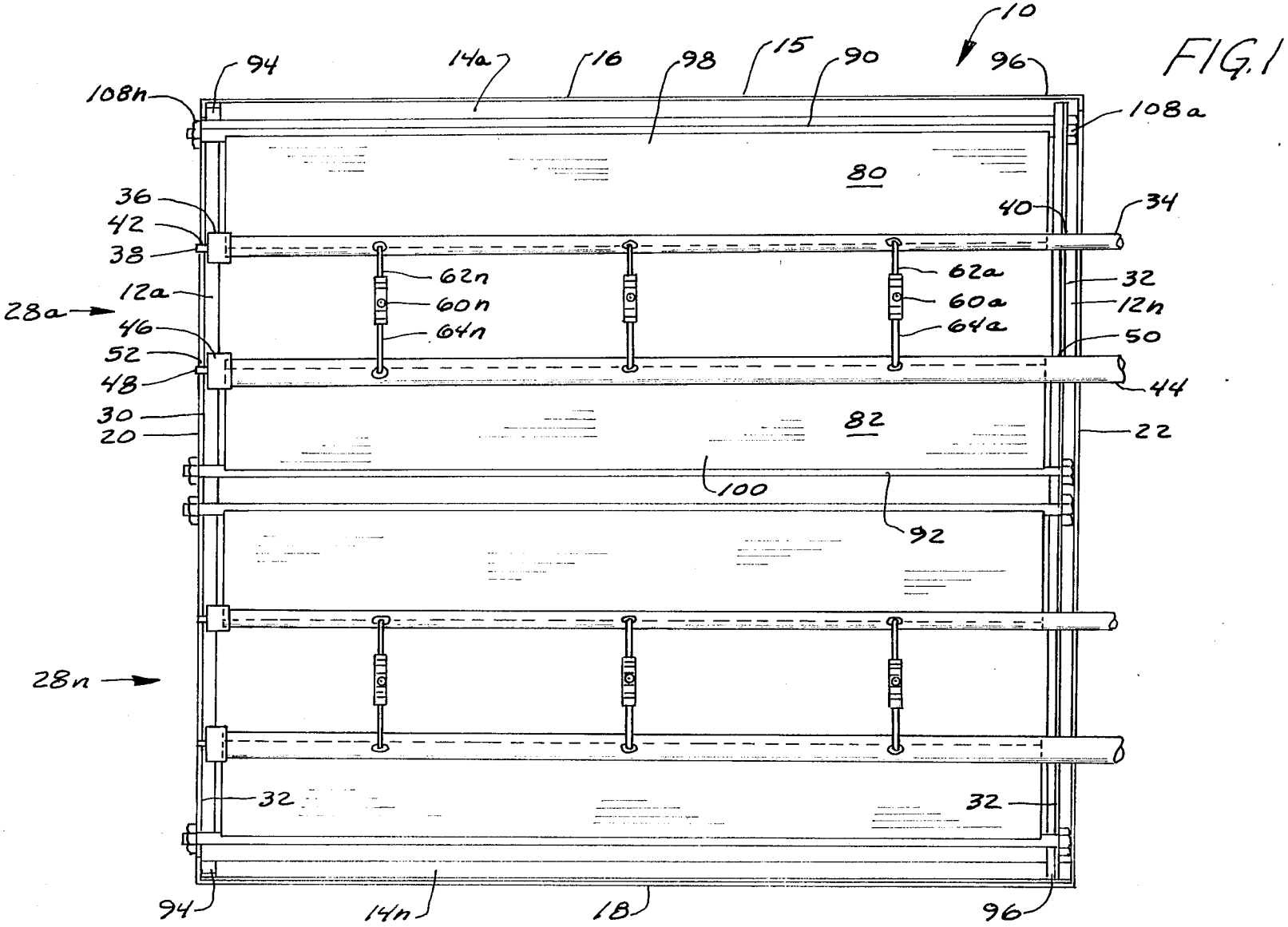
FIG. 1 illustrates a front view of a humidifier system looking into the air stream.
Figure 2:
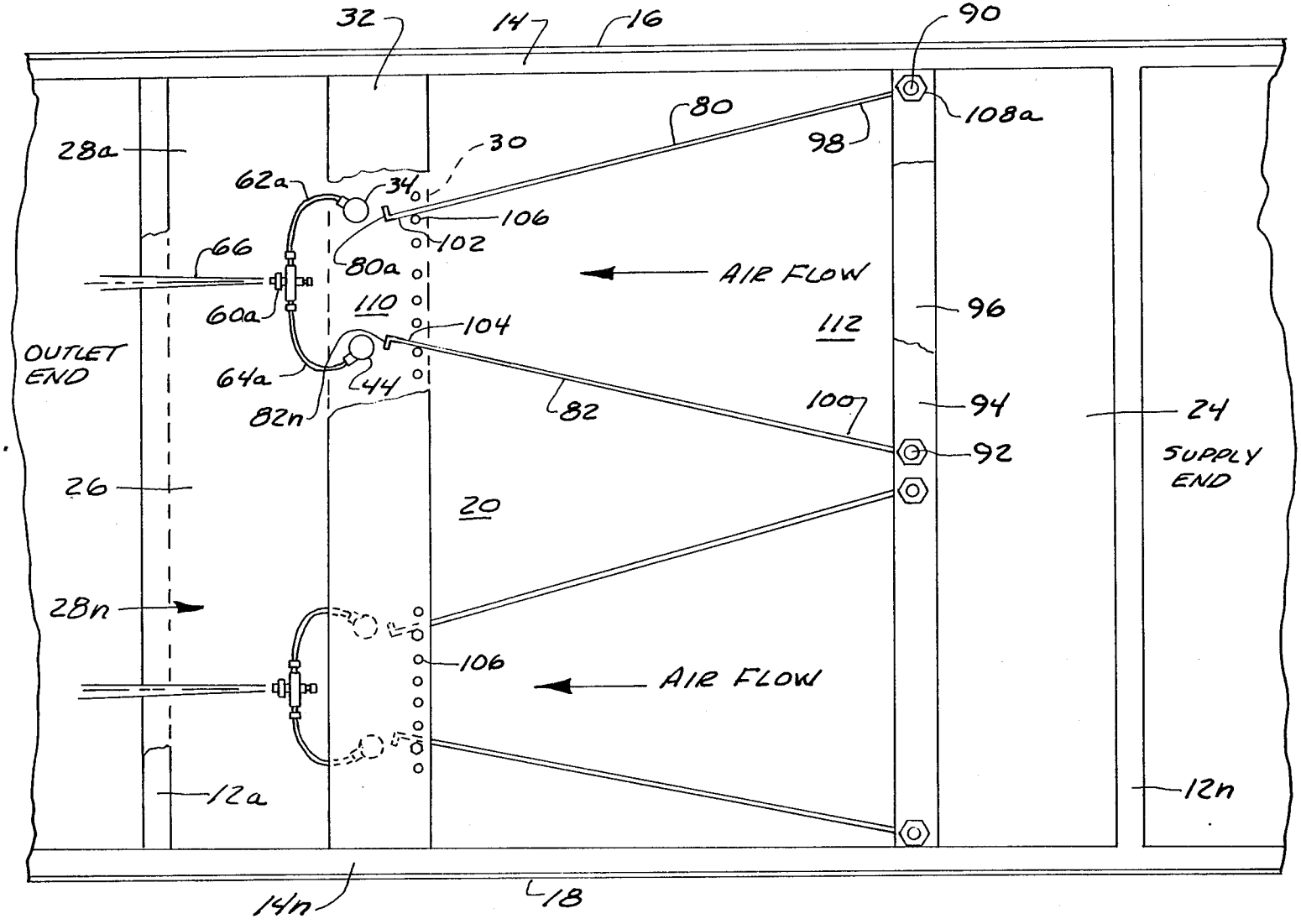
FIG. 2 illustrates a side View of the humidifier system.
Figure 3:
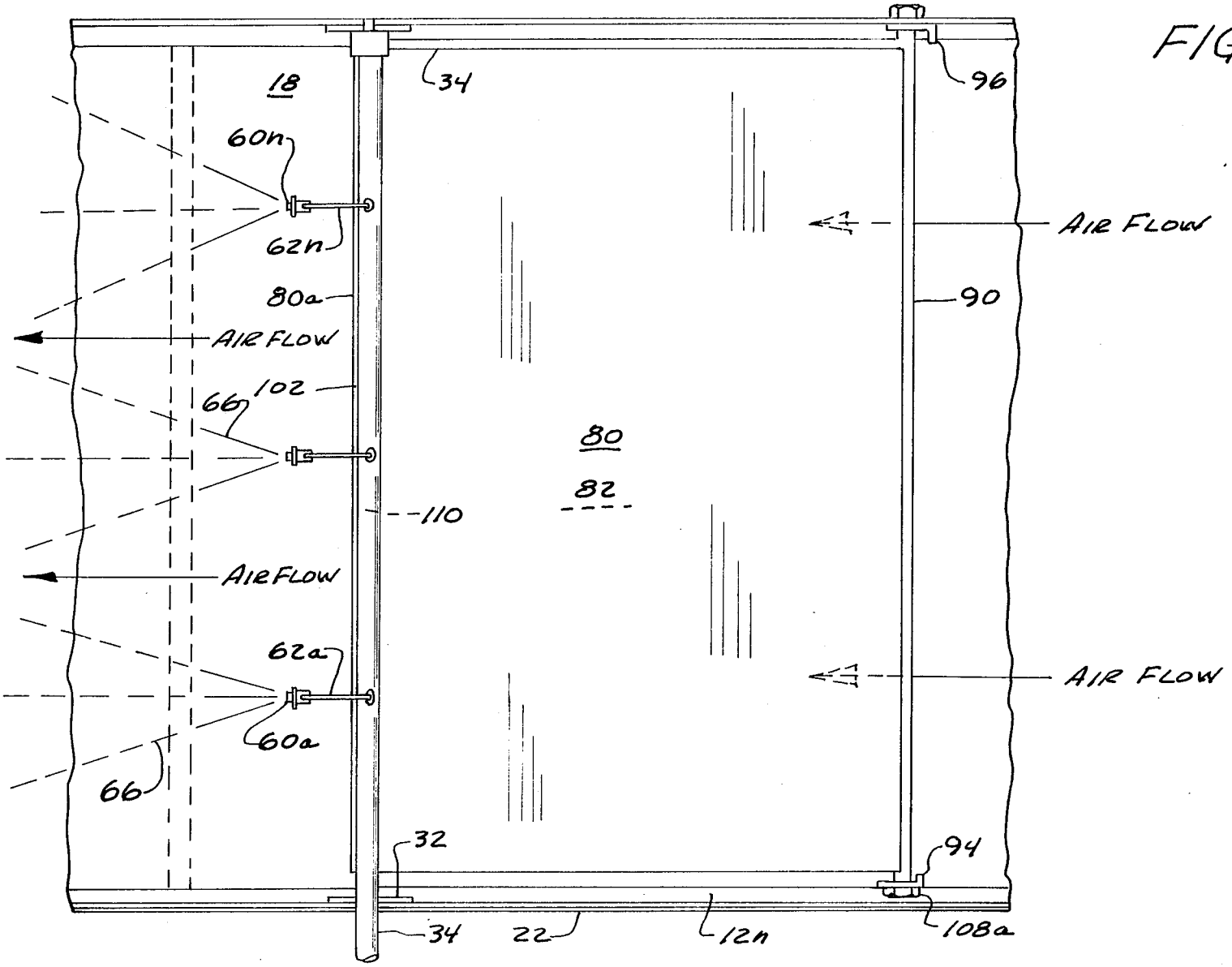
FIG. 3 illustrates a top VieW of the humidifier system.

FIG. 1 illustrates a front view of a humidifier system 10 of the present invention for use in the humidifying of a heating duct. The humidifier system 10 includes a plurality of vertical frame members 12a–12n and a plurality of horizontal frame members 14a–14n. The humidifier assembly includes a planar top duct member 16, a planar bottom duct member 18, and planar side duct members 20 and 22 secured over and about a plurality of vertical and horizontal frame members 12a–12n and 14a–14n. An air inlet end 24 and an air outlet end 26 positioned accordingly at the ends of the humidifier assembly 15 as illustrated in FIG. 2. A plurality of dispersion nozzles making up a spray manifold and a pair of deflector vanes 28a–28n are located in the humidifier assembly 15. For the purpose of brevity and clarity, only one spray manifold and deflector bank 28a will be described, as each of the members of the manifold and deflector vanes 28a–28n are identical to each other. The number and length of manifold and deflector vanes 28a–28n to be installed in a duct system is determined by the physical dimensions of the duct in which it is installed, since the assembly must completely enclose the air stream. Planar vertical bracket members 30 and 32 as also illustrated in FIG. 2, extend vertically between the plurality of horizontal frame members 14a–14n. A tubular manifold member 34 with an end cap 36 and a mounting pin 38 located centrally in the end cap 36 extends between mounting holes 40 and 42 in planar vertical brackets 32 and 30, respectively, for the supply of water into the humidifier assembly 15. In a similar fashion, another manifold member 44 with an end cap 46 and a mounting pin 48 located centrally in the end cap 46 extends between mounting holes 50 and 52 in planar vertical brackets 32 and 30, respectively, for the carriage of compressed air into the humidifier assembly 15. A plurality of adjustable atomizer spray nozzles 60a–60n connect by small tubing members 62a–62n to the tubular manifold member 34 and by small tubing members 64a–64n to the tubular manifold member 44 for the delivery of compressed air and pressurized water respectively to the spray nozzles 60a–60n. Pressurized water is atomized by the action of air pressure upon the pressurized water in the spray nozzles 60a–60n, and is dispersed horizontally in a fan shaped spray 66 as illustrated in FIGS. 2 and 3. Upper and lower deflector vanes 80 and 82 mount in the humidifier assembly 15 to channel the air stream from the air inlet end 24, across the nozzles 60a–60n and the atomized fan shaped spray 66 as illustrated in FIG. 2. An upper support rod 90 and a lower support rod 92 extend between vertically oriented angle brackets 94 and 96, as depicted in FIG. 2, to support the upstream or upwind ends 98 and 100 of the deflector vanes 80 and 82 which are secured thereto. The downstream or downwind ends 102 and 104 of the deflector vanes 80 and 82 include angled ends 80a and 82a, the elevation of which is adjustable to permit more or less air deflection as required. The angled ends 80a and 82a also provide for additional structural support. A strap 106 secures the angled end 80a and 82a and the upper and lower deflector vanes 80 and 82 at the desired elevation. A plurality of nuts 108a–108n secure the upper and lower support rods 90 and 92 to the planar vertical brackets 94 and 96.

FIG. 2 illustrates a side view of the humidifier system 10 where all numerals correspond to those elements previously described. Shown in particular is the arrangement of the deflector vanes 80 and 82. This device encompasses the total interior cross section of the duct in which it is applied. Moving air of the duct enters the inlet end 24 downwind ends 102 and 104 of the deflector vanes and converges to form a narrowed air slot with the narrow portion 110 of the air slot being between the downwind ends 102 and 104 of the deflectors 80 and 82, and the wide portion 112 of the air slot being between the upwind ends 98 and 100 of the deflector vanes 80 and 82. The airflow path abruptly expands to the full duct size at the ends of the deflectors. The flow of air is accelerated as it passes through the narrow portion 110 of the air slot and the air expands rapidly and becomes turbulent as it passes across the nozzles to cause intermingling of the air molecules with the particles of the atomized spray 66. Rapidly evaporation of the spray results. The water mist (or stream) is then carried by the air through the air outlet end 26 to be distributed by the duct system.

FIG. 3 illustrates a top view of the humidifier system 10 where all numerals correspond to those elements previously described. The planar top member is removed to illustrate the intermingling and evaporation of the spray 66 by the air flow after passing through the narrow portion 110 of the air slot formed by the deflector vanes 80 and 82.

DESCRIPTION OF THE ALTERNATIVE EMBODIMENT

Figure 4:
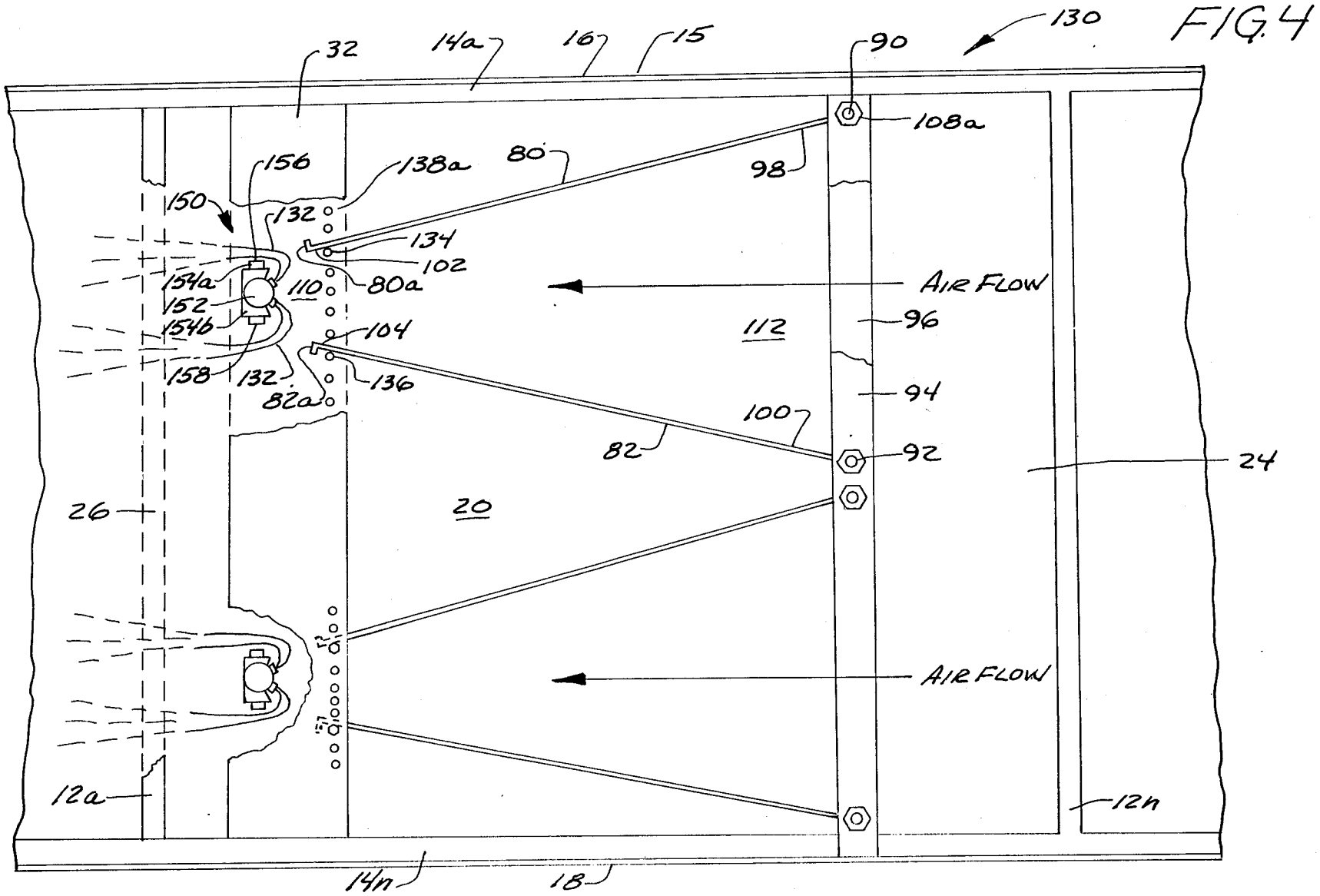
FIG. 4 illustrates an alternative embodiment of a humidifier system.

FIG. 4 illustrates an alternative embodiment of the present invention of a humidifier 130 which is nearly identical to the humidifier system 10 where a steam dispersion tube 150 has been substituted for spray nozzles 60a–60n and tubular manifold members 34 and 44, and where all numerals correspond to those elements previously described. The steam dispersion tube 150 is aligned to spray steam 132 at a diverging angle against the direction of the accelerated air flow for improved dispersion and absorption of the steam 132 Within the humidifier assembly 15. Angled ends 80a and 82a of the deflector vanes 80 and 82 are angled for structural support for downwind ends 102 and 104. Downwind ends 102 and 104 are adjustable and rest on bolts 134 and 136 which can be positioned in different holes 138a–138n for varying the angle of deflection and consequently the cross section of the air path and thus the velocity of air flow across the steam dispersed from the steam dispersion tube 150. A corresponding set of holes similar to holes 138a–138n is located in the vertical planar bracket 32 for support of the deflector vanes 80 and 82, and the holes are not illustrated for sake of brevity and clarity.

Figure 5:
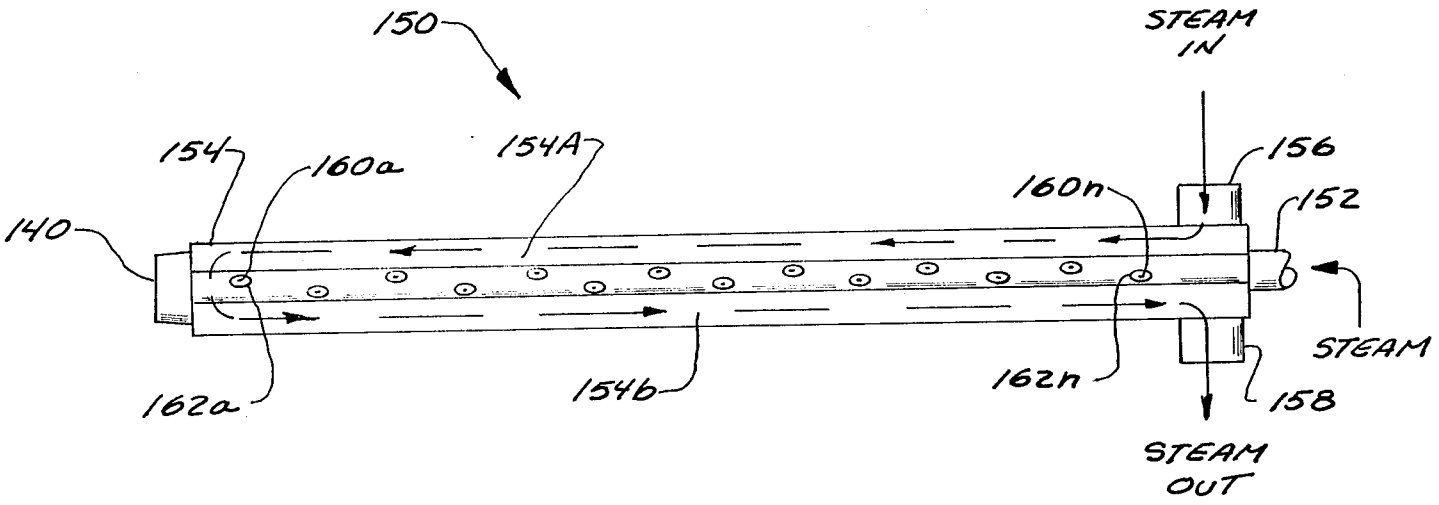
FIG. 5 illustrates a jacketed steam dispersion tube of FIG. 4.

FIG. 5 illustrates an alternative embodiment of a jacketed dispersion tube 150 as also illustrated in FIG. 4 including a central manifold tube 152 and a geometrically configured steam jacket 154 surrounding a major portion of the central manifold tube 152. The steam jacket 154 includes an upper jacket section 154a and a lower jacket section 154b. Steam enters the upper jacket section 154a through a threaded inlet orifice 156, through the upper jacket section 154a, through the lower jacket section, and out of a threaded orifice 158 as indicated by arrows. The central manifold tube 152 is heated by steam traversing through the adjacent steam jacket 154. The central manifold tube 152 disperses steam through a plurality of orifices 160a–160n. The orifices 160a–160n are angled in an alternating manner to provide for desired radial spray of steam from the orifices 160a–160n. The steam tube containing these orifices may be oriented to disperse steam at any desired angle as may be most efficient for the dispersion of steam within the humidifier assembly 15. The orifices 160a–160n are contained in thermoset plastic orifice bodies 162a–162n, such orifice diameter being determined by its required steam flow. Obtaining uniform rates of flow from the orifices along the central manifold tube 152 can be achieved by inserting gradually different sized orifices along the length of the central manifold tube 152. The combination of a central manifold tube 152 with heated steam jacket is ideal in that the temperature of the central tube is kept hot, thereby eliminating dripping due to steam condensation. A typical installation is illustrated in FIG. 4 where the nozzles 60a–60n and tubular manifold members 34 and 44 have been replaced by the jacketed dispersion tube 150. A mounting bracket 140 is positioned across one end of the jacketed dispersion tube 150.

Another alternative embodiment substitutes a non-jacketed steam tube for the jacketed steam tube. Special inner construction of this tube allows the condensation that forms inside the tube to be harmlessly drained away and not enter the air stream.

Various modifications can be made to the present invention without departing from the apparent scope hereof.

I claim:

1. A humidifier system including a humidifier assembly with top, bottom and sides, forming an air inlet and an air outlet comprising:

a tubular manifold member including means for supplying water and pressurized air in a duct means;

a plurality of adjustable spray nozzles connecting to said tubular manifold member, said adjustable spray nozzles dispersing small spray particles;

deflector vane means in said duct means for providing a venturi effect and causing forced air to accelerate as it passes through said duct, said vane means being smoothly tapered to a downstream constriction and terminating at the constriction, there being no obstruction in the duct between the vane means, the air expanding abruptly at the downstream termination of the deflector vane means; and means to mount said spray nozzle spaced downstream from the downstream termination of the deflecting vane means in the path of airflow from between the deflector vane means and in a region of turbulent airflow.

2. The humidifier system of claim 1 wherein said deflector vane means comprise a pair of vanes that converge in downstream direction, the vanes having upstream ends that are mounted to permit the downstream ends to be adjusted, and means for adjusting the space between the downstream ends of said pair of vanes.

3. A humidifier system including wall means forming a duct that is of a first predetermined size, and having an air inlet and an air outlet at opposite ends thereof comprising:

at least one pair of deflector vanes in said duct, said vanes extending across said duct and forming an air channel that converges in a downstream direction, said vanes having downstream ends defining an outlet opening, and terminating along a plane so that the air path for air through said duct means expands abruptly at the outlet ends of said vanes, the space between the vanes being unobstructed; and a humidification assembly having an output for adding humidity to the air in the duct, said humidification assembly being spaced downstream from the downstream end of said vanes, in a region where the air passing through the outlet formed by said vanes becomes turbulent caused only by expansion of air as air exits from the downstream ends of the vanes, whereby the assembly for adding humidity to the air is mounted in a region of turbulent air for enhancing intermixing of the air flowing through said duct with the output from the humidification assembly.

4. The humidifier system as specified in claim 3 wherein said humidification assembly comprises a tubular manifold member including means for supplying water and pressurized air, and a plurality of adjustable spray nozzles connected to the tubular manifold member for providing the output as spray particles in a mist form.

5. The humidifier system as specified in claim 3 and wherein the humidification assembly comprises a jacketed steam dispersion tube having a plurality of nozzles for injecting steam as the output into a region of turbulent air spaced downstream from the outlet between said vanes.

* * * * *